US005111755A

United States Patent [19]

Rouse

[11] Patent Number: 5,111,755

[45] Date of Patent: May 12, 1992

[54] SAFE GUN STORAGE APPARATUS

[76] Inventor: Mark J. Rouse, 4411 NW. 18th St., Suite M-206, Lauderhill, Fla. 33313

[21] Appl. No.: 762,636

[22] Filed: Sep. 18, 1991

Related U.S. Application Data

[63] Continuation-in-part of Ser. No. 468,225, Jan. 22, 1990, abandoned.

[51] Int. Cl.[5] ..... E05G 1/00

[52] U.S. Cl. ..... 109/25; 109/39; 109/47; 109/59 R; 70/63

[58] Field of Search ..... 70/57, 58, 63, 290; 292/57; 109/25, 39, 45, 47, 50-52, 59, 73, 38

[56] References Cited

U.S. PATENT DOCUMENTS

| | | | |
|---|---|---|---|
| 1,817,002 | 8/1931 | Halstead | 109/39 |
| 2,145,314 | 1/1939 | Murtaugh | 109/47 |
| 2,797,405 | 6/1957 | Stelter | 340/280 |
| 3,559,593 | 2/1971 | Munton | 109/25 |
| 3,779,588 | 12/1973 | Raymon | 292/57 |
| 3,797,868 | 3/1974 | Carey | 292/57 |
| 4,155,608 | 5/1979 | Orlewicz | 109/51 X |
| 4,615,281 | 10/1986 | Gaston | 70/63 X |
| 4,649,833 | 3/1987 | Cummins | 109/25 |
| 4,651,544 | 3/1987 | Hungerford | 70/63 |
| 4,722,435 | 2/1988 | Mareels et al. | 206/1.5 |
| 4,768,021 | 8/1988 | Ferraro | 109/38 X |
| 4,800,822 | 1/1989 | Adkins | 109/59 R |
| 4,838,052 | 6/1989 | Williams et al. | 70/63 |
| 4,890,466 | 1/1990 | Cislo | 70/63 |

*Primary Examiner*—Renee S. Luebke
*Assistant Examiner*—Suzanne L. Dino
*Attorney, Agent, or Firm*—Richard M. Saccocio

[57] ABSTRACT

A safe gun storage apparatus is disclosed for the storage therein and ready accessibility of a loaded handgun, said storage apparatus having child-deterrent latching apparatus provided therein is disclosed. A gun drawer containing a loaded handgun is retained within a cabinet which is substantially impervious to destruction and being pried open. Dual entry locking apparatus secures the loaded gun with the storage container. A first locking apparatus involving entry of a predetermined key punch code first unlocks a secondary child-deterrent latching apparatus. The latter unlatches after a given sequence of operations are carried out which then unlatches a latching bolt from within an opening provided within the drawer. The accessibility and, therefore, the gun within the drawer is provided in a quiet and otherwise undetectable mode of operation.

15 Claims, 5 Drawing Sheets

FIG.13
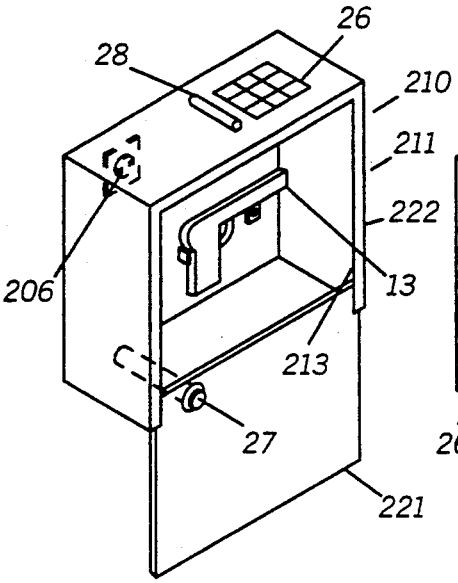
FIG.14
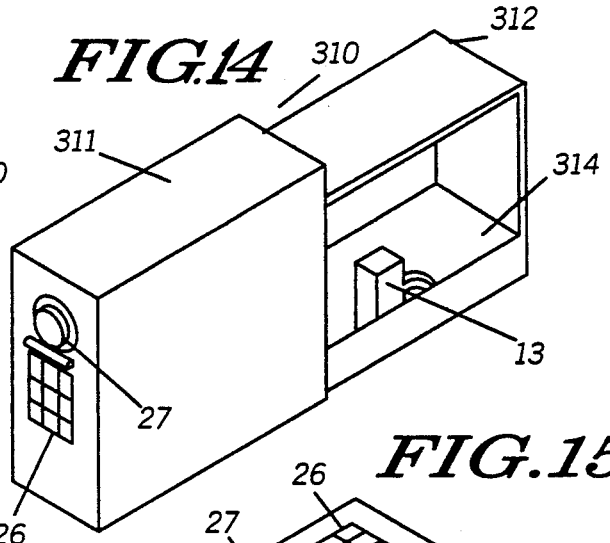
FIG.15
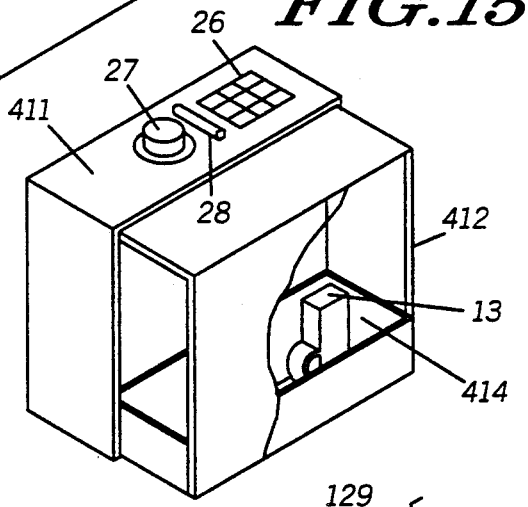
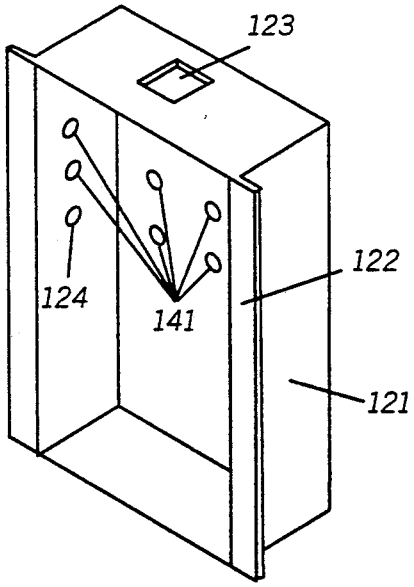
FIG.16
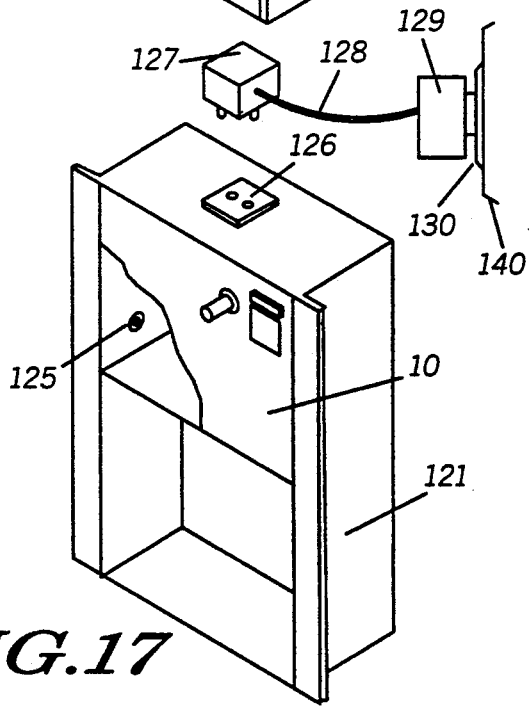
FIG.17

SAFE GUN STORAGE APPARATUS

This application is a continuation-in-part of U.S. patent application Ser. No. 468,225, field Jan. 22, 1990, now abandoned.

BACKGROUND OF THE INVENTION

1. Field of the Invention

This invention relates in general to a lockable container for a loaded handgun and in particular to a doubly locked container for the safe storage of a loaded handgun at a residence, which is substantially childproof and yet readily accessible by an individual desiring quick and quiet access to a loaded handgun.

2. Description of the Prior Art

In this day and age there is, unfortunately, the ever increasing need for an individual to store a loaded handgun at his home so as to deter and prevent home burglaries and other such crimes where the confines of a person's home is breached by an individual or individuals having criminal intentions. Thus, there is a rapidly growing need for a container which enables the safe storage of a loaded handgun at a residence and yet does not allow for access thereto by a child or any other person not authorized to enter the same. Accordingly, a container for the safe storage of a loaded handgun as previously noted, is a desirable asset.

While the prior art includes and discloses a number of containers which are lockable and intended for use with a loaded handgun, none of these devices are as safe as they should be from children easily gaining access to the same and yet permit an adult within the household to relatively easily and quietly gain access to the contents of such a container when the need arises.

A good many of the prior art containers for the safe storage of a loaded handgun include an audible alarm system as a means to detect the unauthorized access or attempt to access the storage container. In these types of devices it is hoped that an adult or other responsible member of the household hears the audible alarm system and immediately takes steps or other measures to prevent a child from accessing the loaded handgun and hopefully prevent accidental injuries resulting therefrom. It is well documented, however, that given the innate curiosity of children coupled with other psychological factors such as the need or desire to show off to their peers, that many children do gain access to such loaded handguns and do inflict albeit accidental harm upon others. Sometimes, this accidental harm results in death. Then, too, these types of storage containers rely upon a responsible or other person hearing the audible alarm. It is well known that children are often in a house unattended by adults and, therefore, even the sounding of a audible alarm would be of no avail.

Accordingly, it is a primary object of the present invention to provide a safe gun storage apparatus which is very difficult or substantially impossible to be breached by a child whether an adult is within the near vicinity or within the house or not.

Another undesirable aspect of the prior art gun storage facilities, regardless of the number or type of alternative locking systems provided with the device, is the ability of a child or even an unauthorized adult, to gain access to the storage container by the use of a simple screw driver or other appropriate flat-bladed tool which may be used to pry apart the container.

Accordingly, another object of the present invention is to provide a safe gun storage apparatus which prevents access to the contents by a person using a simple flat-bladed tool.

Another undesirable feature of some of the prior art gun storage containers involves the use of a lock and a key to gain access there into. In order to maintain the security of such a device, it is imperative that the key or keys thereto are stored or kept at a location which is inaccessible to children or other unauthorized persons. Unfortunately, when it is necessary or desirable for an authorized person to gain access to the gun storage device, it is first necessary to locate and obtain the key or keys which are, in part, required to open the container and which may be hampered by the hiding of the keys. Thus, when access to a gun storage facility is necessary, the main purpose for keeping a loaded gun on the premises may be completely frustrated because of the time involved in obtaining the key or keys and manipulating the lock of these prior art devices.

Accordingly, another object of the present invention is to provide a safe gun storage apparatus for storage of a loaded handgun which does not utilize a lock and key system.

Still other objects of the present invention are to provide a safe gun storage apparatus for a loaded handgun which is made from a material which is substantially indestructible, to provide an aesthetically appealing container which permits the use of the same in an open and non-hidden mode in a home, to provide a container which may be opened by an authorized person or other responsible person with little or no light being available for manipulation of the locking systems, and to provide a safe storage container which, when open, allows ready accessibility in order to obtain physical possession of the loaded handgun; and, to provide a safe storage container which when opened to gain access to the loaded handgun, such opening is done in a quiet, substantially noiseless manner.

The above-stated objects as well as other objects which although not specifically stated, but are intended to be included within the scope of the present invention, are accomplished by the present invention and will become apparent from the hereinafter set forth Detailed Description of the Invention, Drawings, and the Claims appended herewith.

SUMMARY OF THE INVENTION

The above and present objects as stated above and in other parts of this Specification, as well as others, are provided by the present invention which comprises a keyless, dual-entry lock control system in combination with a completely enclosed container intended primarily for storage of a loaded handgun in a residence.

A gun storage container having only one side which opens to provide access to a loaded handgun, with all other sides being completely enclosed, is fastened to a wall or other appropriate surface using fasteners which are not accessible to the outside surfaces of the container. A first locking system comprising a digitally encoded keyboard system is provided on one convenient surface of the container for which a sequenced code number must be properly punched in before a secondary locking system is activated. The secondary locking system comprises a child-deterrent locking arrangement which involves the pushing, pulling and turning of a knob in a particular sequence to finally allow access to the loaded handgun stored therein.

Upon entering the proper first encoded sequence of numbers or letters, a solenoid plunger comprising a dead-bolt lock unlocks the child-deterrent mechanical secondary device. Upon proper manipulation of the secondary locking device which cannot be seen from the outside, a drawer within the container or the front surface of the container opens and thereby exposes the loaded handgun therein. Little or no light is required to enter the proper code numbers and/or letters for the keyboard locking system and for manipulating the secondary child-deterrent locking device. The inventive device supplies its own light which is of sufficient intensity to allow the seeing of the keyboard but not so intense as to forewarn an intruder as to deterrent activity taking place. The invention does not include an audible sound alarm so that when the container is opened substantially little or no sound is emitted there from, which sound could be disadvantageously heard by an intruder. The invention is further provided with a completely enclosed container which does not contain any outside assembly, disassembly or container mounting fasteners so as to prevent unauthorized entry by merely unscrewing one or more fasteners. Further, in this regard, the drawer within which the loaded gun is kept within the container is inserted within the container and up against peripheral edges thereof such that a flat-bladed pry tool would be of little avail in attempting to gain access therein in this improper manner.

BRIEF DESCRIPTION OF THE DRAWINGS

Various other objects, advantages, and features of the invention will become apparent to those skilled in the art from the following discussion taken in conjunction with the following drawings, in which:

FIG. 13 is a simplified, schematic view of another embodiment of the safe gun storage apparatus wherein the access to the gun is obtained by lowering of the front panel;

FIG. 14 a simplified, schematic view of another embodiment of the safe gun storage apparatus wherein the gun drawer slides out from the side of the cabinet;

FIG. 15 is a simplified schematic view of another embodiment of the safe gun storage apparatus wherein the gun drawer slides out from the front of the cabinet;

FIG. 16 is an isometric front view of a frame member within which the gun storage apparatus may fit therewithin for purpose of inserting the storage gun apparatus within a wall; and FIG. 17 is an isometric front view of the gun storage apparatus fitting within the frame member of FIG. 16.

DESCRIPTION OF THE PREFERRED EMBODIMENTS

Figure 1:
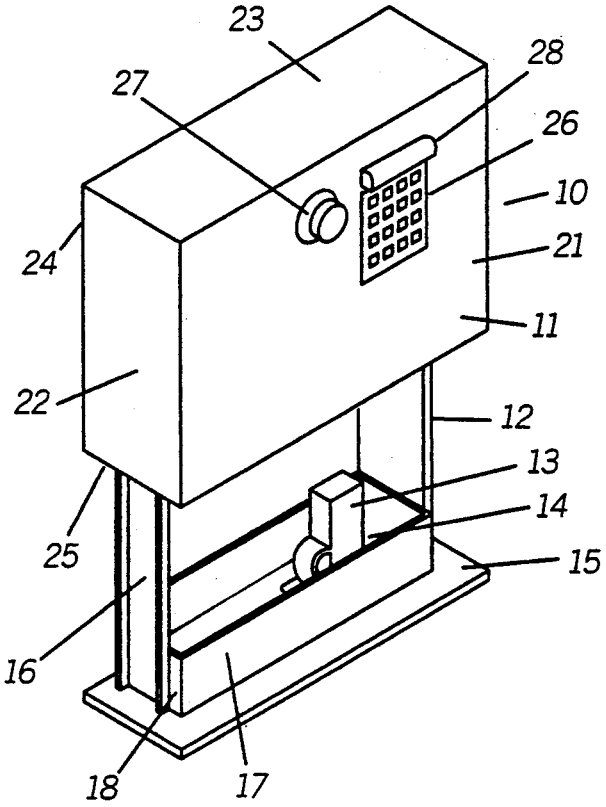
FIG. 1 is a schematic view of a preferred embodiment of the inventive safe gun storage apparatus illustrating the dual system locking devices on the exterior thereof and the gun drawer being lowered from within the container to allow access to the loaded handgun.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Referring now to FIGS. 1 through 8 of the drawings, which taken together show the various details of the arrangement and construction of the safe gun storage apparatus 10 comprising an outer container 11 and a gun drawer 12 contained therein, the latter being released and re-locked by a digital keyboard security system 26 and a child-deterrent locking mechanism 27. The outer container 11 preferably comprises a one-piece, molded container having a front panel 21, a back panel 24, two sides panels 22, and an upper panel 23. Container 11 may also comprise a multi-piece welded or even glued assembly which cannot be disassembled. The lower side 25 of container 11 is open. In the configuration shown, container 11 may, as previously stated, be molded from a one-piece, plastic component made from a shatter 25 and break-resistant plastic such as LEXAN®. The gun drawer 12 is designed to fit up within the opening in container 11 and slide down along the sides thereof so as to render as readily accessible a loaded handgun 13 which fits within a open enclosure 14 of the gun drawer 12.

Figure 3:
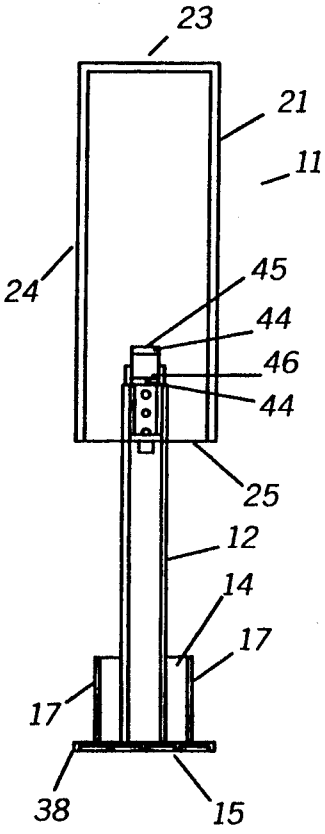
FIG. 3 is a side view of the gun container with the gun drawer being lowered.
Figure 2:
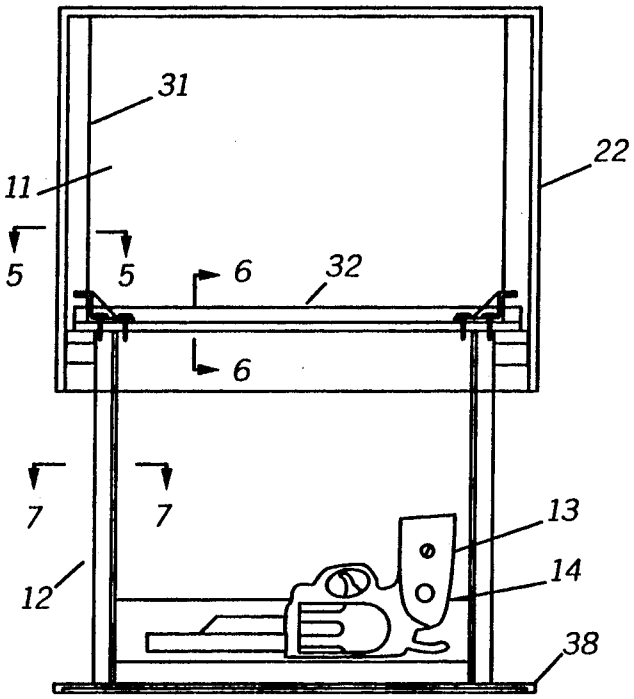
FIG. 2 is a plan view of the safe gun storage apparatus illustrating the downward position of the gun drawer.
Figure 5:
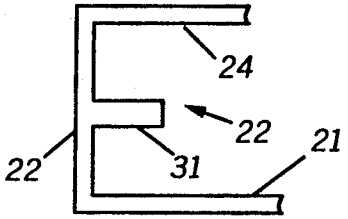
FIG. 5 is a partial cross-sectional view of the structure arrangement of the side panel of the gun container taken along the line 5—5 of FIG. 2.
Figure 6:
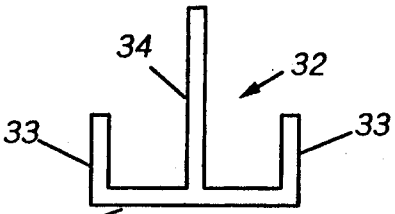
FIG. 6 is a cross-sectional view of the top support member of the gun drawer taken along the line 6—6 of FIG. 2.
Figure 7:
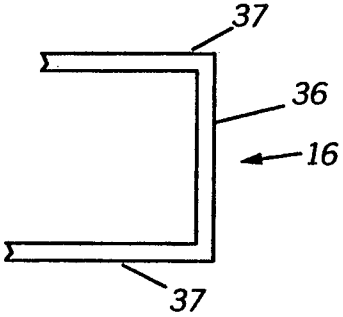
FIG. 7 is a cross-sectional view of the side rail of the gun drawer taken along, the line 7—7 of FIG. 2.

Gun drawer 12 may comprise a bottom panel 15, the previously-mentioned storage compartment 14, a pair of side rails 16, and an upper support member 32. Bottom panel 15, storage compartment 14, and side rail 16 may all comprise a single piece of molded plastic while top support member 32 may comprise a separate structural member which is attached to the side rails 16 of gun drawer 12. FIGS. 2 and 3 show the various details of container 11 and gun drawer 12 in relation to each other with the gun drawer 12 being shown in a downward or released position. FIGS. 5 through 7 show the cross-sectional configuration of the side panels 22 of container 11, the top rail support member 32 of gun drawer 12, and the side rails or members 16 of gun drawer 12, respectively.

In FIG. 5 it is seen that the storage container 11 includes side panels 22 having a flange member 31, all of which extend the approximate length thereof. In FIG. 7, the top support member 32 is seen to comprise an E-shaped channel member having a flat bottom panel 35 and vertical side panels 33 attached thereto. A center reinforcing flange member 34 is also provided with top support member 32. In FIG. 7, the side members 16 of gun drawer 12 are seen to comprise a U-shaped channel member having a flat plate portion 36 with extending side flange portions 37.

Figure 9:
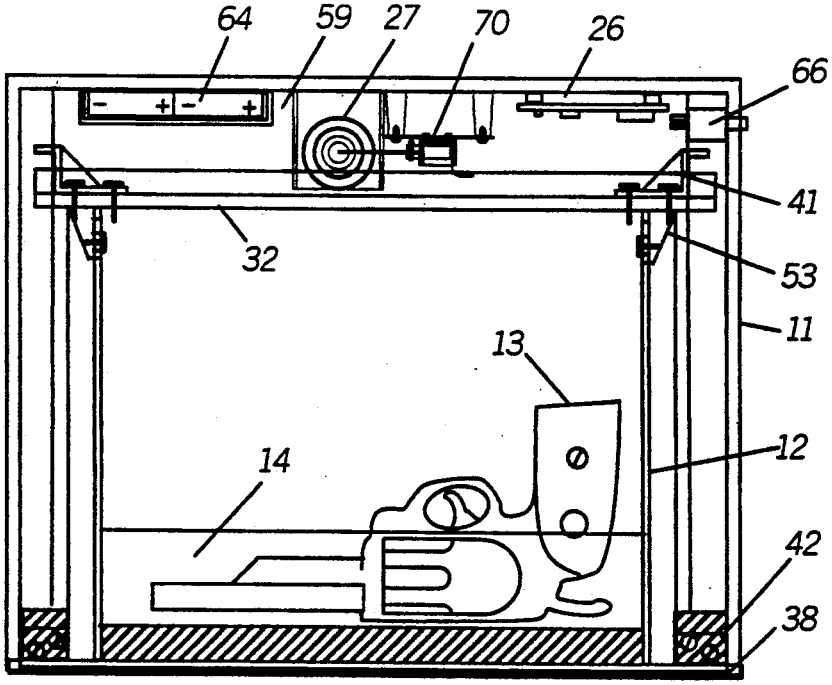
FIG. 9 is a somewhat enlarged section of the gun drawer, inserted within the container with the front cover removed, and being a plan view thereof, partially in cross section.
Figure 8:
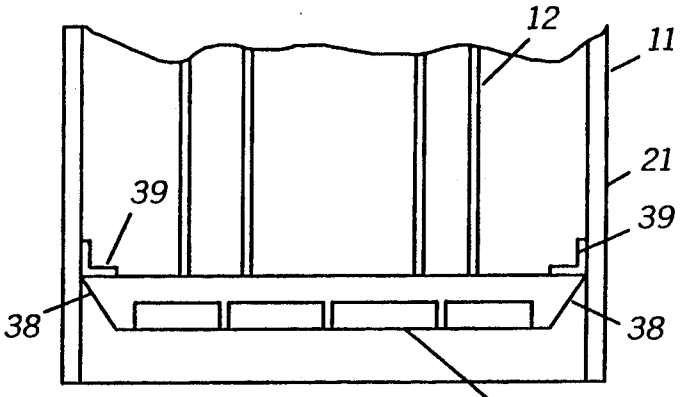
FIG. 8 illustrates a side view, partially in cross section, of the fit up arrangement between the cabinet and the gun drawer, further illustrating the deterrent against forced entry thereof.

Bottom panel 15 is seen also in FIG. 8 to have sloped edge surfaces 38 such that when gun drawer 12 is fully inserted within container 11, as shown in FIGS. 8 and 9, the sloped edges 38, as they extend away from the inside wall of the container 11, effectively prevents the occurrence of a fulcrum or lever position for a flat bladed tool to be used to pry the drawer open. In addition, metal angle member 39 extends the length and depth of the cabinet 11 at the inner junction of the front, back, and side panels just above the top surface of bottom panel 15. Thus, an ordinary person and especially a child would not be able to pry the bottom edge 38 of gun drawer 12 downward so as to overcome the double lock system as hereinafter described.

Figure 8A:
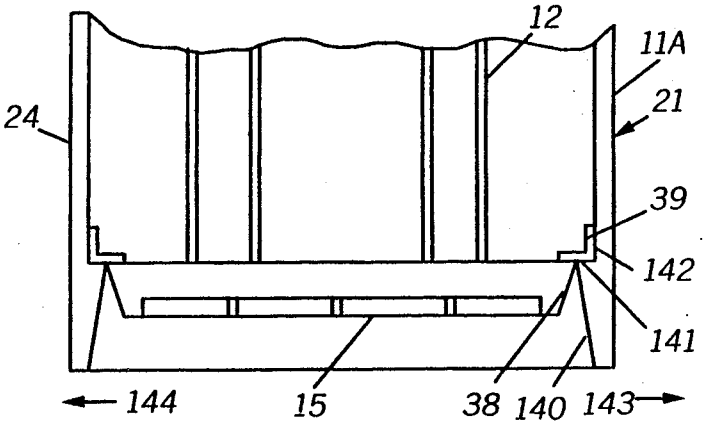
FIG. 8A illustrates a side view, partially in cross section of the fitup design between the cabinet and the gun drawer, further illustrating an alternate deterrent against forced entry thereof.

An alternate pry proof design is shown in FIG. 8*a*. In this embodiment, a ledge 141 in conjunction which a sloped surface 140 is provided at the lower inside end of panels 21, 22, and 24. The angle member 39 rests against ledge 141 and thereby prevents a flat bladed tool from being inserted between surface 142 of angle member 39 and inside surface 143 of panels 21, 22, and 24 when, for example, panels 21, 22, and 24 are pulled in the direction of arrows 143 and 144. Also, the width of leg 145 of angle member 39 prevents the formation of an open gap.

Figure 4:
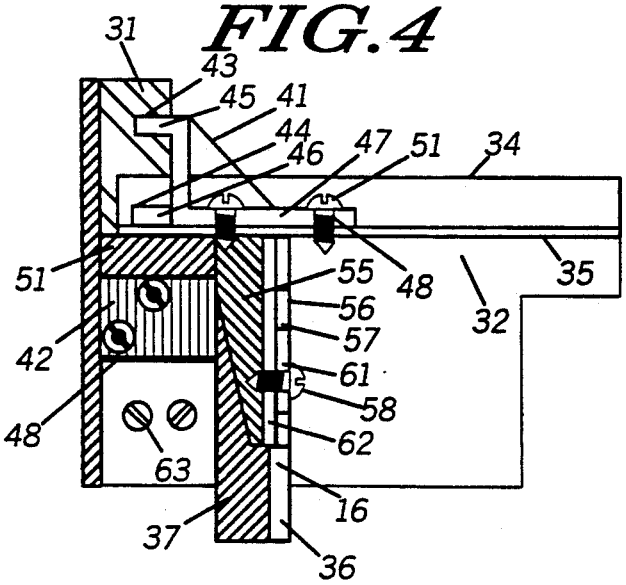
FIG. 4 is an enlarged plan view, partially in cross section, of the cabinet guide rail arrangement and the drawer travel stop.

FIG. 4 illustrates the attachment of the top support rail 32 to gun drawer 12 as well as the sliding guide rail arrangement between the drawer 12 and inside of the container Il and the stop 42, the latter of which is utilized to limit the downward travel of gun drawer 12. Each longitudinal end of top support member 32 includes an integrally formed downwardly extending support member 53. Downwardly extending support member 53 includes a plate member 54 which is substantially perpendicular to the bottom plate 35 of top support member 32. A pair of angled gusset plates 55 are connected between the bottom of plate 35 and the outside surface of lower extending plate 54 so as to supply additional stiffness to the connection of downwardly extending plate member 54 to bottom plate 35 of support member 32. Downwardly extending support member 53 further includes a substantially vertically aligned pair of bosses 56 which fit within openings 57 in the upper part of the flat plate member 36 of the side members 16 of gun drawer 12. Bosses 56, in conjunction with holes 57, provide for accurate alignment of top support member 32 to the side support member 16 of gun drawer 12. A fastener member 58 passing through hole 61 is threaded into downwardly extending member 54 to secure support member 32 to side rails 16 to complete the construction of gun drawer 12. In this manner, support member 32 is accurately and firmly attached to rails 16 of gun drawer 12.

A guide block 41 is attached to the upper surface of plate member 35 of top support member 32 at each end thereof. Guide blocks 41 serve to guide the travel of gun drawer 12 as it travels downward and upward within container 11. In this regard, as may be seen in FIG. 4 of the drawings, fastener members 51 are used to secure the bottom plate 47 of guide blocks 41 to the flat plate portion 35 of support member 32. Guide blocks 41 include slots 45 and 46 between flange members 43 and 44, respectively, which slots fit therein a portion of the glide flange 31 attached to the side surfaces 22 of container 11.

A drop support block 42 having spaces 47 for fit up with the bottom portion of guide rail 31 is provided on each side of container 11 to limit the downward travel of gun drawer 12. The drop support blocks 42 are fastened to guide flange 31 by means of fasteners 48. A foam rubber or other appropriate similar material member 51 is provided on the top surface of drop support blocks 42 to silently cushion the downward fall and stop of gun drawer 12 when it is released to gain access to the loaded gun 13 therein.

FIG. 9 illustrates gun drawer 12 fitted up within container 11 when gun 13 is being used in a safe storage mode. For purposes of illustration, the front panel 21 is removed. As seen in FIG. 9, a space 59 exists between the top support member 32 of gun drawer 12 and the top plate 23 of container 11. Space 59 houses a battery storage compartment 64 which provides either backup or primary electrical energy to the digital keyboard locking apparatus 26 and to the light source 28 which illuminates the keyboard 26. An alternative electrical energy input fitting 66 is also provided to provide permanent electrical energy to the keyboard locking apparatus 26.

Keyboard locking apparatus 26 may be designed such that any desired and predetermined combination of numbers and letters in a given sequence, when pressed, will activate solenoid apparatus 70. Additionally, keyboard locking mechanism 26 may be arranged such that the pressing of any one of the buttons contained thereon will activate a light source 28 (FIG. 1) which serves to illuminate the keyboard 26.

Figure 10:
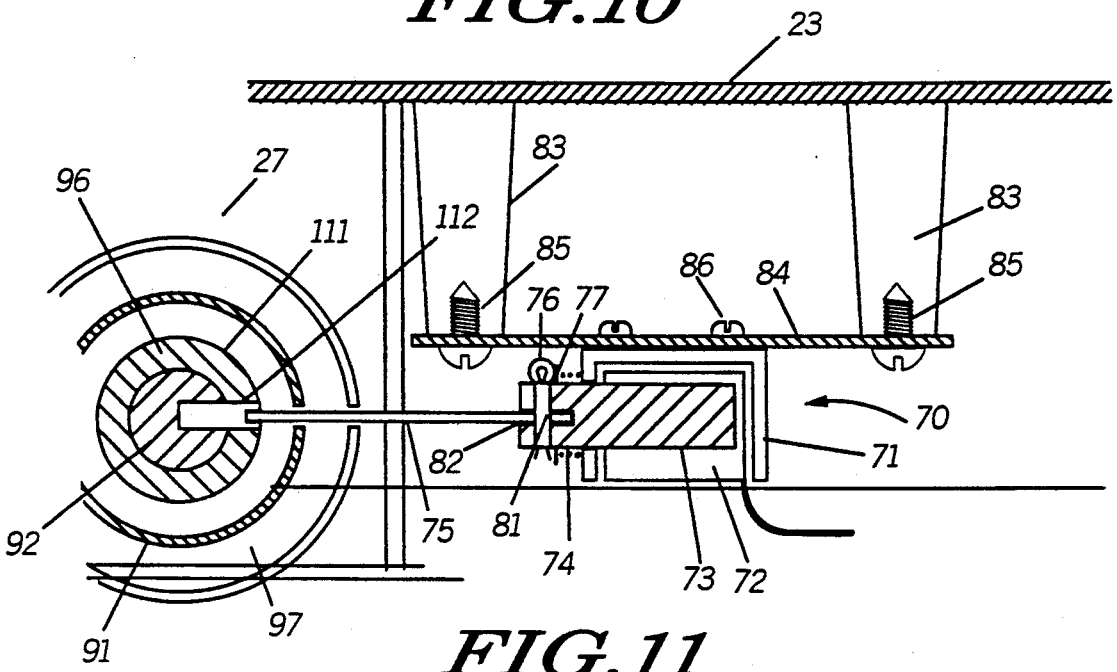
FIG. 10 is a plan view, partially cross sectioned, enlarged view of the locking arrangement of FIG. 9.

As seen in FIG. 10, solenoid apparatus 70 comprises a housing 71 which is attached by fasteners 86 to a plate member 84 which is in turn attached by fasteners 85 to mounting bosses 83 of cabinet 11. Internally, solenoid apparatus 70 comprises a typical 12 and conventional electrical coil 72 within which a solenoid plunger 73 moves axially therewithin upon the powering of coil 72. The exposed end of plunger 73 includes a hole 78 within which is co axially located a pin 75. Pin 75 is secured within hole 78 by means of a cotter pin 76 which passes through aligned holes 81 and 82 in plunger 73 and pin 75, respectively. A washer 77, in conjunction with spring 74, provides for a positive mechanical location of pin 75 within holes 112 and 111 of cylinder flange 97 and locking bolt 92, respectively. Thus, when solenoid apparatus 70 is energized, solenoid plunger 73 and, hence, pin 75 are withdrawn from hole 111 and thereby compresses spring 74.

Figure 11:
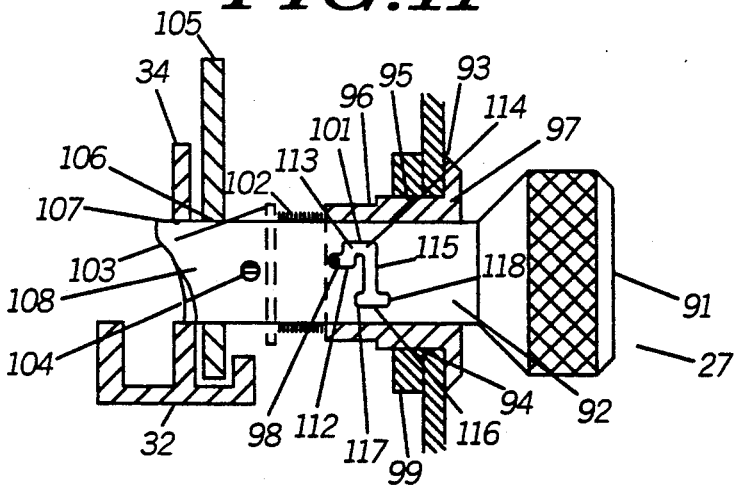
FIG. 11 is a side view, partially in cross section, of the child-deterrent locking arrangement illustrating the locking system in the locked position.

FIGS. 10 and 11 together illustrate the various components of the child-deterrent locking system 27. A locking bolt 92 having a knurled knob 91 attached thereto fits within an opening through cylinder housing 93, the latter being retained to the front wall 21 of cabinet 11 by means of the threaded connection 95 with cylinder retaining nut 99 and the outside flange 97 of cylinder housing 93. Accordingly, it is seen that cylinder housing 93 is fixed relative to the front wall 21 of cabinet 11 while locking bolt 92 may slide axially relative to cylinder housing 93. In order to assure proper axial movement of locking bolt 92, the distal or remote end thereof is supported within a hole 106 within a plate supporting member 105 extending downward from the top surface 23 of cabinet 11.

The locking end 108 of locking bolt 92 fits within an opening 107 in the central flange 34 of top support member 32 of gun drawer 12. When the locking portion 108 of locking bolt 92 fits within hole 107 of top support member 32, the gun drawer 12 is retained within its uppermost position within cabinet 11. At this point, the gun 13 is fully secured within the safe gun storage apparatus 10.

In order to further assure the locking position of bolt 92 within top support member 32, a compression spring 102 is fitted between the remote end 96 of cylinder housing 93 and a washer 103 positioned further therealong bolt 92. A split pin 104 retains the washer 103 in position on locking bolt 92.

The moving sequence of locking bolt 92 is shown in FIG. 12 of the drawings. The moving sequence is predetermined by a guide pin 98 extending radially from a fixed position on locking bolt 92 and a variously-shaped groove 101 in cylinder housing 93. It is to be noted that groove 101 is not visible from the outside of container 11. It is only when guide pin 98 exactly follows the travel of the varying groove 101 from its initial position to its final position within groove 101, that locking bolt 92 may be disengaged from top support member 32 and thereby allow the gun drawer 12 to drop from within cabinet 11. As previously stated, in FIG. 11, locking bolt 92 is locked within the upper support member 32 of gun drawer 12. This position corresponds to that of FIG. 12A. In order to disengage the locking bolt 92 from gun drawer 11, the following sequence of events must occur after the correct sequence of numbers has been entered into the keyboard locking mechanism 26 and pin 95 has been removed from hole 111 in locking bolt 92. In FIG. 12B, the knob 91 of locking bolt 92 is pulled rearward such that the guide pin 98 attached thereto moves to the rearward most position of groove 112 of varying groove 101. Then, knob 91 is rotated clockwise to cause guide pin 98 to travel upward in groove 113 to its uppermost position therein (FIG. 12C). The movement of the bolt locking 92 shown in FIG. 12D is axially rearward such that guide pin 98 travels along groove 114. At this point in the sequence it is seen that the very tip of the end portion 108 of locking bolt 92 is only slightly, however, still in contact with the opening in top support member 32.

Figure 12C:
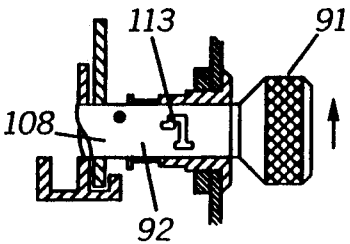
FIGS. 12A through 12G illustrate, in sequence, the movement of the locking bolt required to disengage the same and thereby release the gun drawer.
Figure 12B:
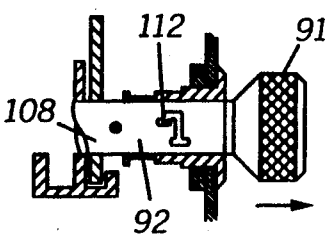
Figure 12A:
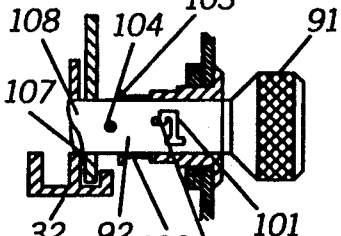
Figure 12F:
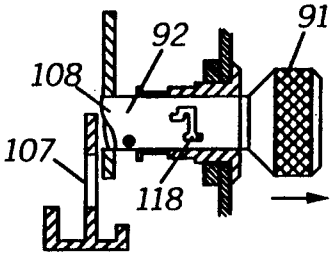
Figure 12E:
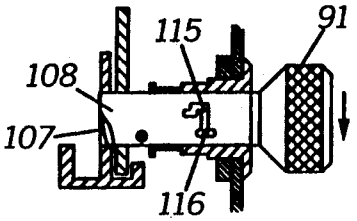
Figure 12D:
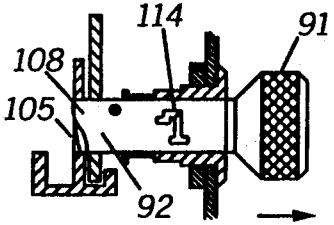

As shown in FIG. 12E, knob 91 is then rotated 14 counterclockwise such that guide pin 98 travels downward within groove 115 to a mid position within groove 116 at the lowermost travel point thereof. Next, knob 91 of locking bolt 92 is pulled rearward as shown in FIG. 12F, such that guide pin 98 travels toward end 118 within groove 116 and at which time the forward end 108 of locking pin 92 clears the hole within top support member 32 thereby releasing gun drawer 12 in a downward direction. At this time, the loaded gun 13 is rendered accessible from within the safe gun storage apparatus 10.

Inherent in the embodiment shown in FIGS. 1, 11 and 12 of the drawings, it may be observed that groove 101 is not visible form the outside of outer container 11, thus, the person manipulating knob 91 must, of course, know the sequence of movement from memory in order to properly manipulate bolt latch 92 to release gun drawer 12.

It is to be noted that the invention is not to be limited to the particular shape of groove 101 shown in the drawings nor the particular sequential movement associated with said groove. Any combination of in and out, up and down, and even sloped manipulation of the knob in accordance with an accordingly shaped groove are also intended to be covered by the invention.

Figure 12G:
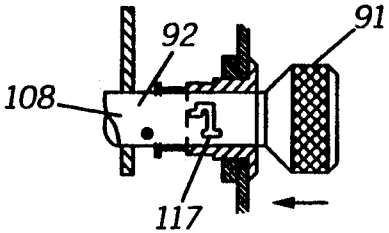

After the gun drawer 12 drops down to the open position, the natural tendency of the authorized person entering the safe gun storage apparatus will release the knob 91 of locking bolt 92. This will result in locking bolt 92 moving forward such that guide pin 98 travels through the forward most position 117 within groove 116. This forward motion of locking bolt 92 is caused by the action of spring 102 against washer 103 thereby moving locking pin 98 in the forward direction and come to rest as shown in FIG. 12G.

Once gun 13 is replaced within the receptacle 14 within gun drawer 12, moving the gun drawer upward causes the top surface of top support member 32 to engage the sloped portion of the end portion 108 of locking bolt 92 and due to the slope thereof causes locking bolt 92 to slide rearward. The continued upward motion of the gun drawer then permits locking bolt 92 to enter into hole 107 within top support member 32 and thereby reengage the gun drawer 12 within container 11. However, it is to be noted that the position of locking bolt 92 attained thereby will be that as shown in FIG. 12G and with the locking bolt slightly engaged within top support member 32. In order to fully secure the child deterrent locking arrangement 26, it is necessary for the person having authorized access to the gun safety apparatus to reverse the sequence of operation of steps of FIGS. 12A through 12G. The reverse operation of the opening steps results in locking bolt 92 being re-positioned as shown in FIG. 12A, which is the locked position. When guide pin 98 is again positioned in the forward end of slot portion 112 of groove 101, the hole 111 within locking bolt 92 again aligns with hole 112 in the locking bolt cylinder 93 and further in alignment with pin 75 of solenoid apparatus 70. The keyboard locking arrangement 26 is designed such that pin 75 retracts only temporarily, that is for a period of, for example, five-to-ten seconds. The compressive force stored within spring 74 thus stands ready to reinsert pin 75 into hole 111 upon alignment thereof. This occurs when locking bolt 92 again attains the locked position shown in FIG. 12A of the drawings.

FIG. 13 illustrates another embodiment of the inventive safe gun storage apparatus 210. In this embodiment, the front panel 221 slides downward with regard to container 211, thereby exposing gun 13 therewithin. Gun 13 may be supported on blocks 212 secured to the back wall 224 of cabinet 11. Front panel 221 may be of sufficient weight such that it relatively easily slides down grooves 213 within the side panels 222 of cabinet 211. The release and downward travel of front panel 221 may again be controlled by the child-deterrent safety apparatus 27 which operates in conjunction with a hole within member 214 extending downward from the top panel 223 of cabinet 211. Again, child-deterrent locking system 27 may be released only after a correct sequence of code numbers are punched into the keyboard locking apparatus 26.

FIG. 14 illustrates yet another embodiment of the inventive safe gun storage apparatus 310 wherein the gun drawer 312 slides sideways out of container 311. The operation of locking mechanism 27 and keyboard mechanism 26 is as explained in the previous embodiments.

FIG. 15 illustrates an embodiment where the drawer 412 slides out from the front of cabinet 411. Again, the operation of locking mechanism 27 and keyboard mechanism 26 is as explained in the previous embodiments.

In FIGS. 16 and 17, a means for inserting the safe gun storage apparatus within a wall is illustrated. A frame member 121 may comprise an open container having a pair of oppositely disposed flanges 122 thereon. Frame members 121 may be made form sheet aluminum or steel or even plastic. Frame member 121 is intended to fit within an appropriately proportioned opening in a wall and may be secured thereto by appropriate fasteners 141 which are covered over when safe gun storage apparatus is fitted within frame member 121. Flanges 122 may be used to limit the insertion of frame member 121 within a wall. An opening 123 is provided in the top panel of frame member 121. One or more openings 124 may also be provided in the side panels of frame member 121.

Safe gun storage apparatus 10 fits snugly within frame member 121 with an electrical receptacle 126 provided on top panel 23 of container 11, fitting up and through opening 123. Electrical receptacle 126 is connected to the various electrical components within safe gun storage apparatus 10. One or more pin members 125, which are accessible only when gun drawer 12 is in a released position (not shown in FIG. 17), may be used to lockingly attach safe gun storage apparatus 10 to frame member 121. Safe gun storage apparatus 10 is, therefore, not readily detachable from frame member 121 by an unauthorized person, including a child.

An electrical plug 127, wire 128 and transformer 129 may be connected to receptacle 126 and an suitable 120 volt source 130 attached to a wall 140. Such connection, of course, provides a proper supply of electrical power to safe gun storage apparatus 10. A hidden switch (not shown) can be used to disrupt the electrical power to safe gun storage apparatus 10 and thereby render the same even further childproof.

It is to be noted that as previously explained, safe gun storage apparatus may be directly connected to a wall or other vertical surface without the need for frame members 121. However, frame member 121 also provides for portability of safe gun storage location (such as a boat) provided that both locations are each fitted with a frame member 121.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the scope of the breadth and scope of the claims herein appended.

I claim as my invention:

1. A child-deterrent, safe gun storage apparatus for storage therein of a loaded handgun comprising a container, gun drawer storage means, lockingly fitted within said container, a first locking means for locking a second locking means, said second locking means providing for release of said gun storage drawer containing said gun, and said second locking means comprising locking apparatus having a variously shaped groove in combination with a pin or like device which groove and pin are unobservable from outside of the container, whereby said second locking means is unlocked by moving said groove relative to said pin in a predetermined sequence of axial and circumferential movements.

2. The safe gun storage apparatus of claim 1, wherein said child deterrent locking apparatus includes a locking bolt engageable within an opening securing said gun drawer to said container.

3. The apparatus of claim 2, wherein said child deterrent locking apparatus comprises said locking bolt having a pin attached thereto and a cylinder apparatus within which said locking bolt is slidingly received, said cylinder including said varyingly shaped groove.

4. The apparatus of claim 3, wherein said sequence of operations includes a first axial movement, a first circumferential movement, a second axial movement, a second circumferential movement, and a third axial movement.

5. The apparatus of claim 1, wherein said first locking means comprises a keyboard arrangement operatively connected to a solenoid, said solenoid having a plunger therein, said plunger being lockingly fitted within a latching bolt of said second locking means.

6. The apparatus of claim 1, wherein said gun drawer containing said gun is releasable downwards with regard to said container.

7. The apparatus of claim 1, wherein said gun drawer containing said gun is releasable sideways relative to said container.

8. A child-deterrent, safe gun storage apparatus for storing a loaded gun therein comprising a container, a slidable panel lockingly attached to said container, a first locking means for lockingly securing a second locking means, said second locking means providing for unlocking of said slidable panel and gaining access to said gun, and said second locking means comprising a child-deterrent locking apparatus whereby predetermined manipulation of said first locking means and predetermined unobservable movement of said second locking means causes said slidable panel to side open relative to said container.

9. The apparatus of claim 8, wherein said second locking means comprises a locking bolt engageable within an opening within said container, said locking bolt having a pin therein, said pin fitting within a varyingly shaped groove in a cylinder within which said locking bolt slidingly fits, said cylinder containing said varyingly shaped groove.

10. The apparatus of claim 1, wherein said gun drawer containing said gun is releasable from the front of said container.

11. The apparatus of claim 8, wherein said slidable panel comprises the front panel of said container.

12. The apparatus of claim 1, wherein said gun drawer includes a bottom panel which forms the botton panel of said container when said gun drawer is secured within said container, said bottom panel having sloped side edge means for preventing said gun drawer from being pried open by use of a flat bladed tool.

13. The apparatus of claim 12, including angled metal members attached to the inside surface of said container at the location of the upper surface of said gun drawer bottom panel when said gun drawer is fully inserted within said container.

14. The apparatus of claim 12, wherein said container includes front, side and back panels with an open bottom end, said front, side and back panels at the location of said open bottom end, each including sloped inside surface means for forming a ledge which covers an interface between an angle member resting on said ledge on the inside surface of said container.

15. The apparatus of claim 1, including frame means for positioning said safe gun storage apparatus therebetween, said frame means being adaptable to be fitted within an opening in a wall or other like structure.

* * * * *